United States Patent [19]

Sah

[11] Patent Number: 4,607,694

[45] Date of Patent: Aug. 26, 1986

[54] WELL PLUG QUALITY TESTING

[76] Inventor: Ramesh Sah, 1027 Edgemont Rd., N.W. Calgary, Alberta, Canada, T3A 2J5

[21] Appl. No.: 691,872

[22] Filed: Jan. 16, 1985

[51] Int. Cl.[4] ..... E21B 47/00

[52] U.S. Cl. ..... 166/250; 166/285; 173/151

[58] Field of Search ..... 166/250, 253, 285, 113; 73/151, 155

[56] References Cited

U.S. PATENT DOCUMENTS

| | | | |
|---|---|---|---|
| 2,451,472 | 10/1948 | Coggeshall | 166/253 |
| 3,911,740 | 10/1975 | Calhoun | 175/48 |
| 4,043,394 | 8/1977 | Campell | 166/253 |
| 4,120,166 | 10/1978 | Brooks, Jr. | 166/253 |

FOREIGN PATENT DOCUMENTS

| | | |
|---|---|---|
| 1016065 | 3/1977 | Canada . |
| 1094799 | 2/1981 | Canada . |

*Primary Examiner*—James A. Leppink
*Assistant Examiner*—Hoang C. Dang
*Attorney, Agent, or Firm*—David J. French

[57] ABSTRACT

A method is described for testing the quality of cement slurry installed in a borehole to form a plug. The density of the cement, when relatively pure, is compared with the density after the slurry has been placed in situ and has been exposed to potential contamination. The presence of a contaminant is detected by a departure in the measured density from the value for when the cement is relatively pure.

2 Claims, 2 Drawing Figures

WELL PLUG QUALITY TESTING

This invention relates to a method of testing the quality or purity of a cement mixture or slurry placed in the borehole of a well while it is still fluid and prior to its becoming set. More particularly, this invention relates to testing for the contamination of cement plugs being placed within the borehole of an abandoned well to isolate geological strata and zones within the ground.

BACKGROUND OF THE INVENTION

When a borehole drilled for exploration and development of oil and gas is abandoned, a number of cement plugs, in the form of cement slurry, are placed at different depths as required by the regulatory authorities. The plugs are placed so that the fluids from the deeper horizons do not contaminate the water table and upper fresh water sands which may be used as a future water zone.

References to past procedures for inserting plugs in abandoned wells and to installing or testing cement within boreholes may be found in the following list of previously published patents:

1. U.S. Pat. No. 2,171,840—Armentrout and Gudie—describes a method of locating a cement slurry in a well by measuring electrical resistivity, inductance or dielectric capacitance.
2. U.S. Pat. No. 2,220,205—Buckley—describes a method of locating a cement slurry in a well by measuring gamma ray emissions.
3. U.S. Pat. No. 3,489,219—Higgins—describes a method of locating a cement slurry in a well by measuring gamma ray emissions pH, temperature, electromagnetic transmittance, electrical resistivity, dielectric capacitance or magnetic permeability of the cement.
4. U.S. Pat. No. 3,490,528—McClain—describes a method of testing the effectiveness of a cement plug in a borehole by "tagging".
5. Can No. 1,016,065—Campbell—describes a method of locating a cement slurry in a well by measuring radioactive emissions.
6. Can No. 1,094,799—Bennett—describes a method of locating a cement plug in a well by detecting temperature and radioactive emissions.

According to the procedures typically followed, a cement plug, generally 10 to 50 meters in length, is positioned between zones requiring isolation. This cement plug is positioned in the borehole utilizing the rig's tubular string, and pumping a measured quantity of cement slurry from the surface to the desired depth. This cement slurry displaces the drilling mud at the desired well bore depth and the drill string is withdrawn while the cement hardens.

Generally, two techniques are currently used to determine if the position of the cement plug is correct. One technique uses the rig's tubular string to go down to plug depth to "feel" for the plug, by the procedure known as "tagging". Once the cement has hardened, the tubular string is lowered to the plug top and the surface indication of tubing string weight reduction indicates if the plug has been contacted. The length of pipe is then used to indicate the plug's position.

The second technique is more involved and utilizes radioactive material mixed in the cement at surface, prior to the cement being pumped. The slurry is then pumped and positioned normally at the bottom of the pipe string. Then a measuring device, usually a scintillation gamma ray detector type, is lowered on a wireline to the top of the cement plug. An increase in the gamma ray reading indicates the plug position, and this increase and depth is permanently recorded. With this technique, wireline length is measured and indicates the plug's relative position in the borehole. Both techniques only measure the "position" of the plug.

While previous efforts have been focused on techniques for locating the position of the cement plug being installed in a borehole, or testing the quality of the cement bond between pipe casings and adjacent formations, this invention relates to the testing of the quality, purity or degree of contamination of the cement forming the plug itself.

According to existing procedures, the cement slurry is introduced into the borehole by injecting it into the stream of drilling mud which is being pumped down the pipe string to the bottom of the pipe stem. Ideally, the cement slurry should be introduced in place of the drilling mud for a controlled period of time and then the flow of drilling mud should resume with no mixing between the respective fluids. In actual fact, the temporary substitution of a flow of fluid cement for a portion of the flow of drilling mud within the drill string is not achieved without some degree of mixing occurring between these two fluids, particularly by the time that the cement slurry reaches the bottom of the pipe string.

Additionally, where the borehole is uncased or the casing is perforated, water, rock, gas, and other contaminating materials may enter from the geological formation surrounding the borehole and mix with the cement slurry as it is being transported for deposition at the end of the drill string.

Whenever drilling mud, water, or other contaminants become mixed with fluid cement, the resulting mixture can no longer be said to comprise 'pure' cement. As the degree of impurity is increased, eventually the cement will not produce the same quality of plug as would be produced by pure cement. Even if the contaminated mixture should be capable of setting, it will still be of lower strength and may be susceptible to forming cracks and fissures. Once significant cracks or fissures form in a borehole cement plug, the plug is less likely to serve its function of isolating flow of underground fluids between adjacent strata. Over time, limited flow of fluids can enlargen the fissures and result in a complete failure by the plug to serve its intended purpose: to isolate adjacent strata.

OBJECTS OF THE INVENTION

It is an object of this invention to provide a method by which the presence of contaminating materials in a cement slurry deposited in a borehole to serve as a plug may be detected.

It is a further object of this invention to provide a method by which the quality of material in a cement plug deposited in a borehole after being exposed to potentially contaminating materials may be measured.

SUMMARY OF THE INVENTION

Accordingly the present invention provides a method of determining the presence of a contaminant in a fluid cement slurry located at a predetermined position within a borehole, where the said slurry when pure has a specific density, and which slurry has been exposed before being placed in position in said borehole to a potential contaminating substance having a density that differs from the density characteristic of the cement slurry to a measurable degree and which will, when mixed with the cement slurry produce a mixture having a density that differs from that of a pure cement slurry by a measurable degree, comprising:

(1) measuring, when said slurry is in a relatively pure, uncontaminated condition, the density of the fluid cement slurry;

(2) measuring the density of said slurry after it has been inserted down a borehole to a predetermined position, and after said slurry may have been exposed to a potentially contaminated substance; and (3) comparing the density of the cement slurry as measured when in situ within the borehole with the density of said slurry when said slurry is in a relatively pure, uncontaminated condition and thereby determining the presence of a contaminating substance within said slurry.

By a further application of the invention the measuring of the cement slurry's density when at its predetermined location is done by progressively lowering a measuring device down the borehole into and through a portion of the zone of the cement slurry when in situ and by comparing the relative values of the measured density as it passes into and through various stages of that zone portion.

By a further application of the invention, the density of the cement slurry when pure is measured on the surface before said slurry is inserted down the borehole.

DESCRIPTION OF THE PREFERRED EMBODIMENT OF THE INVENTION

Figure 1:
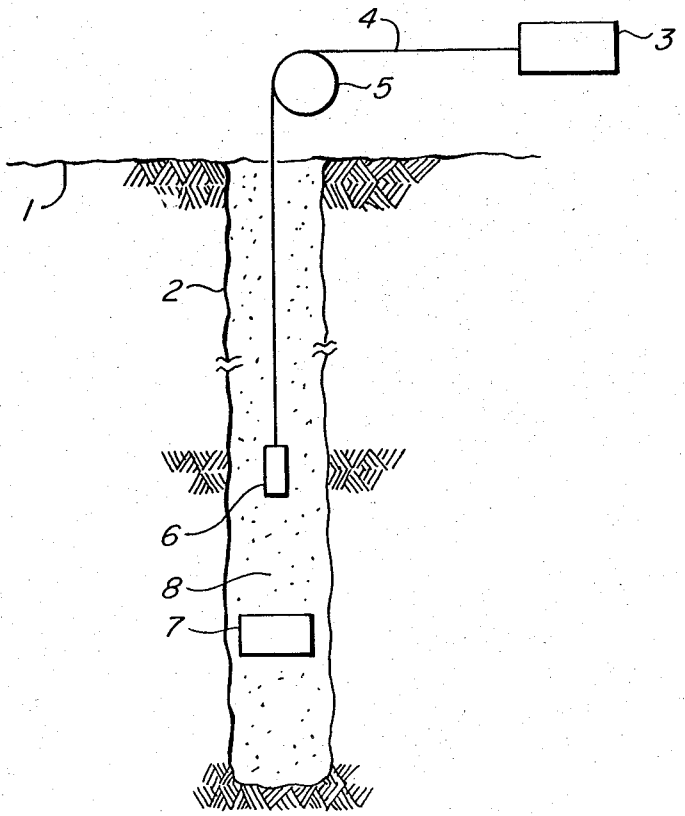
FIG. 1 is a schematic cross-section of a borehole which is filled with drilling mud and a cement slurry placed therein at a predetermined in depth to eventually harden and form a plug.

FIG. 1 shows a schematic of a well bore 2 drilled from a well head 1 for oil or gas production. The borehole 2 is shown as being uncased. Although in many typical situations the borehole 2 would be lined partially or entirely by an outside cylindrical steel pipe case, the presence or otherwise of such a casing is not an essential factor for the carrying out of the invention.

The borehole is generally filled with drilling mud 8 but in the case shown in FIG. 1, a cement slurry 7 has been deposited at a predetermined location therein to eventually harden and form the plug.

According to the method of the invention, a densimeter 6, of the type normally available on the market, is lowered on a wire line 4 down the borehole 2 from the well head 1. This procedure is shown in FIG. 1 in which the densimeter 6 is shown suspended at the end of a wire line 4 part way down to the borehole 2.

At the well head 1, the amount of wire line 4 that has been paid out over the pulley or sieve 5 is measured in the normal manner, thereby providing the distance down the borehole 4 that the densimeter 6 has been lowered.

"Drilling mud" is used for hydrostatic (pressure) well control and removal of drilling debris. Hence, the fluid has basically two very important parameters, fluid density and fluid viscosity, which are monitored and well known. The density of the fluid primarily depends on formation pressures which need to be contained, and may be varied from 1 gm/cc to 2.2 gm/cc. In most cases (more than 80% of the wells drilled in the United States and Canada), the density varies between 1 and 1.5 gm/cc.

Normally, the cement slurry 7 will have been deposited through a pipe string (not shown) which may either have been removed after the slurry 7 has been injected, or has been raised so as to be clear of the cement. In the latter case, the densimeter need only be of the commercially available type which is designed to be small enough to pass through the core of the pipe string.

By way of contrast, the cement typically used to form plugs has a density of on the order of 2.65 gm/cc which differs significantly from that of drilling mud. Conveniently, both the density of drilling mud and of cement slurries being prepared for insertion down a pipe string are carefully monitored at the wellhead before being used.

Other contaminants which may potentially become introduced into the cement slurry will usually also have densities which differ from that of the slurry. Examples are listed as follows:

| | |
|---|---|
| water | 1.00 gm/cc |
| shale | 2.65 gm/cc |
| sand | 2.1-9 gm/cc |
| limestone | 2.71 gm/cc |
| dolomite | 2.87 gm/cc |

When substantial amounts of any of the above listed substances, or other potential contaminants having a density which differs to a measurable degree from that of the cement slurry, become disbursed within the slurry, then the portion of the slurry which has become so contaminated will have a density which differs from that of the pure cement.

The presence of such contaminants in the slurry can be determined by lowering the densimeter 6 down the borehole 2 until it enters the zone of the slurry 7. At that point, the recorded density, as received by the recording system 3, may be compared with the density of the slurry 7 as determined before insertion in the borehole. The degree of departure of the measured density of the slurry in situ in the borehole from the value recorded at the surface will serve as an indication of the presence of a contaminant within the slurry.

Figure 2:
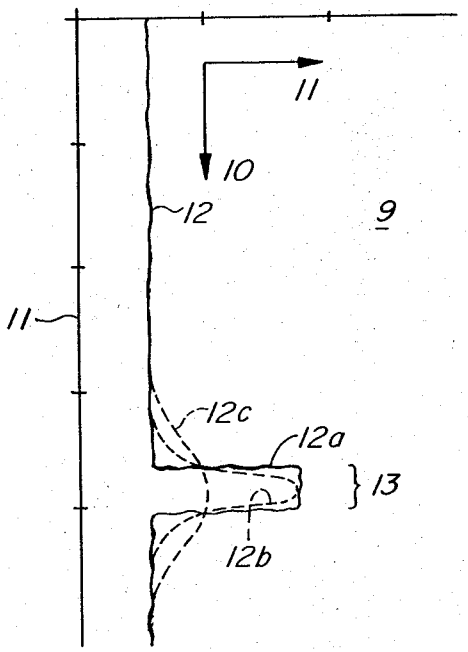
FIG. 2 is a schematic illustration of the data that may be recorded on surface by a recording system connected to a transducer lowered down the borehole through drilling mud and cement slurry.

FIG. 2 is a schematic depiction of a means by which variations in the density of the well bore fluids may be displayed on a foot-by-foot basis.

FIG. 2 shows a roll chart 9 of the type produced by a pen recorder on which the measured density of the fluid in the borehole 2 is graphically traced in step with the depth to which the densimeter 6 has been lowered down the borehole 2.

The direction for increasing depth on the roll chart 9 is shown by the arrow 10. Down the length of the chart is a scale 11 which has been calibrated to correspond to depth below the surface. The arrow 11 indicates the direction in which increasing density is recorded. The trace 12 shows the value of density progressively being recorded as the densimeter is lowered down the well. The zero has either been displaced to the left on the scale for density as shown or has been compressed so as to show an amplified response to changes in density.

For convenience of explanation, FIGS. 1 and 2 have been aligned so that the path of the trace 12 corresponds in alignment to the fluid in the borehole 2 that is being measured.

From FIG. 2, it will be seen that the trace 12 maintains a relatively constant value while the densimeter is descending from the well head through drilling mud 8. As the densimeter enters the boundary between the drilling mud 8 and the cement slurry 7, the trace 12 is displaced from the line of the previous path being followed. In the case shown the cement slurry 7 is assumed to have a higher density than that of the drilling mud 8 and the trace 12 is shown to have been displaced in the direction of arrow 11.

If there has been relatively little mixing between the drilling mud 8 and the cement slurry 7, the trace would typically follow the path 12*a* shown in FIG. 2. In such a case, a zone 13 corresponding to relatively uncontaminated cement or pure cement and constant density would then be traced out. The paths of the trace 12 that would be followed in cases where greater degrees of mixing and contamination have occurred are shown by dotted lines 12*b* and 12*c* respectively.

Where the trace ceases to display a zone 13 of constant density over any measured depth within the cement slurry 7, it may be assumed that contamination has spread throughout the cement plug. In such cases, and in cases where the zone 13 is unduly short, remedial steps may then be taken to drill out and reset the plug, or place an ancillary back-up plug above the defective one.

The use of a trace which measures the physical parameter of density over the boundary zone between the drilling mud and cement slurry does not require that the precise values of the parameter be measured in absolute terms. It is sufficient that a comparative mesurement be made. The slope of the trace at the boundary is an indication of the degree of mixing of the contaminant. To obtain absolute values for the degree of contamination, the density of the cement slurry, may be measured on the surface, prior to its insertion in the borehole, while pure. This step may also be carried out in respect to the drilling mud where it is considered to be the likely contaminant.

The foregoing description has been based on the physical parameter of density as a means for detecting the dispersion of a contaminating substance within a cement slurry. In those cases in which the potential contaminant, e.g. drilling mud, has a density which is not measurably different from that of the cement slurry, then another physical parameter may be measured. Measurement of another physical parameter may also be done in conjunction with density measurement to provide additional confirming data as to the presence of contamination.

Other physical parameters which may be used are the following: Electrical Resistivity; Inductive Capacity; Dielectric Capacity; Electromagnetic Transmittance; and Acoustic Conductance.

Apparatus for measuring these parameters in a borehole are available on the market or may be constructed according to the principles of existing available products.

The degree of departure of the measured value for a contaminated cement slurry from the pure or surface value in respect of any of the physical parameters employed will depend on the degree of mixing of the contaminant with the slurry, and on the difference in the measured value of such parameter for the contaminant from that of a pure slurry. In cases were either the differences in the parameter values or the degree of mixing are insufficient to show a measurable change in the parameter for the slurry when installed in the borehole, then the method described will not work. Nevertheless, where a measurable change does occur, the method does serve to provide some information on the condition of the slurry.

The foregoing description of the preferred embodiment is one example of the application of the invention disclosed herein. The full scope of the invention is as set forth in the claims which follow hereafter.

I claim:

1. A method of determining the presence of a contaminant in a fluid cement slurry located at a predetermined position within a borehole, wherein said slurry when pure has a specific density and which slurry has been exposed, before being placed in position in said borehole, to a potential contaminating substance having a density that differs from the density of the cement slurry to a measurable degree and which will, when mixed with the cement slurry produce a mixture having a composite density that differs from that of a pure cement slurry by a measurable degree, comprising:

(1) measuring, when said slurry is in a relatively pure, uncontaminated condition, the density of the fluid cement;

(2) measuring the density of said slurry after it has been inserted down a borehole to a predetermined position, and after said slurry may have been exposed to a potentially contaminated substance, by progressively lowering a measuring device down a borehole into and through a portion of the zone of the cement slurry when in situ; and (3) comparing the density of the cement slurry as measured when in situ within the borehole, and the relative values of the measured density as said measuring device passes into and through various stages of said zone portion, with the density of said slurry when said slurry is in a relatively pure, uncontaminated condition, and thereby determining the presence of a contaminating substance within the slurry.

2. A method as in claim 1 wherein the density of the cement slurry when pure is measured on the surface before said slurry is inserted down the borehole.

* * * * *